US006263822B1

(12) United States Patent
Fontenot et al.

(10) Patent No.: US 6,263,822 B1
(45) Date of Patent: Jul. 24, 2001

(54) RADIAL ELASTOMERIC SPRING ARRANGEMENT TO COMPENSATE FOR HULL DEFLECTION AT MAIN BEARING OF A MOORING TURRET

(75) Inventors: William L. Fontenot; Miles A. Hobdy; L. Terry Boatman, all of Houston, TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/680,594

(22) Filed: Oct. 6, 2000

Related U.S. Application Data

(60) Provisional application No. 60/157,946, filed on Oct. 6, 1999.

(51) Int. Cl.[7] ..... B63B 21/00
(52) U.S. Cl. ..... 114/230.12; 441/3
(58) Field of Search ..... 114/230.1, 230.12; 441/3–5

(56) References Cited

U.S. PATENT DOCUMENTS 4,955,310 * 9/1990 Pollack .
5,052,322 * 10/1991 Poldervaart et al. .
5,306,186 * 4/1994 Boatman .
5,356,321 10/1994 Boatman et al. .
5,515,804 * 5/1996 Pollack .
5,839,387 11/1998 Myklebust .

FOREIGN PATENT DOCUMENTS

PCT 96/27522
WO * 9/1996 (WO) .

* cited by examiner

*Primary Examiner*—Stephen Avila
(74) *Attorney, Agent, or Firm*—Gary L. Bush; Mayor, Day, Caldwell & Keeton, LLP

(57) ABSTRACT

Elastomeric pads are arranged radially around the main bearing which rotatably supports a mooring turret with respect to a vessel. The elastomeric pads act as radial springs to react the radial turret loads in the vessel and to compensate for ovaling of the vessel in response to sea environmental forces on the vessel. A radial spring assembly is provided which applies compressive load to the elastomeric pads when the vessel and turret move radially toward each other, but prevent tension from being applied to the pads when the vessel and turret move radially away from each other.

4 Claims, 1 Drawing Sheet

RADIAL ELASTOMERIC SPRING ARRANGEMENT TO COMPENSATE FOR HULL DEFLECTION AT MAIN BEARING OF A MOORING TURRET

CROSS REFERENCE TO RELATED APPLICATION

This Non-Provisional Application claims priority from Provisional Application No. 60/157,946 filed on Oct. 6, 1999.

BACKGROUND OF THE INVENTION

1. Field of the Invention

This invention relates generally to turret moored offshore vessels and in particular to a radial elastomeric spring arrangement for the main bearing of a mooring turret to compensate for hull deflections or distortions of the moored vessel.

2. Description of the Prior Art

Heretofore, elastomeric springs have been provided for supporting an upper bearing of a mooring turret for a moored vessel. For example, U.S. Pat. No. 5,515,804 dated May 14, 1996 shows a bearing support for a mooring turret in which a plurality of equally spaced resilient support structures support the upper bearing. Each support structure includes a post secured to the turret and extending downwardly from the turret at a 45 degree angle with a plurality of elastomeric shear pads between upper and lower post portions of each post The heavy weight of the mooring chains causes bending of an upper hull beam and the shear pads in the posts may move closer together or further apart as a result of unequal forces from the mooring chains.

Other elastomeric arrangements for reacting radial loads or forces from a turret mounted on a main bearing have included a plurality of radially extending support members mounted about the turret and having elastomeric bumper pads between the turret and hull of the moored vessel. The elastomeric bumper pads act as shock absorbing devices to assist in limiting radial deflection of the turret.

3. Identification of Object of the Invention

A principal object of the invention is to provide a radial spring arrangement between main bearing of a mooring turret and a vessel which compensates for ovaling of the vessel due to environmental forces at sea on the vessel.

SUMMARY OF THE INVENTION

The spring arrangement of the present invention includes a radial spring subassembly comprising a plurality of radially extending elastomeric springs spaced around the main turret bearing to react radial turret loads into the hull of the moored vessel and to isolate the turret from ovaling of the hull or body of the moored vessel. Ovaling of the hull of the vessel is caused by environmental forces on the vessel in heavy sea conditions. Each radial spring subassembly is moimted between the main bearing for the turret and the hull of the moored vessel The radial spring subassembly according to the invention includes a pair of concentric telescoping cylinders with one cylinder secured to the vessel and the other cylinder secured to an end plate for the elastomeric member and movable with the elastomer member. The telescoping cylinders which slide relative to each other, are effective for transmitting compressive loads and shear loads to the elastomeric member but not tension loads. The radial spring subassembly reacts the radial turret loads at the upper main bearing of the turret and also reacts the torsional loads of the main bearing resulting from bearing friction. The elastomeric pad of the radial spring subassembly is subjected to shear loads upon axial movement of the turret. The radial springs do not have enough lateral stiffness to absorb the entire axial load even although they do absorb part of the axial load.

DESCRIPTION OF THE INVENTION

Figure 1:
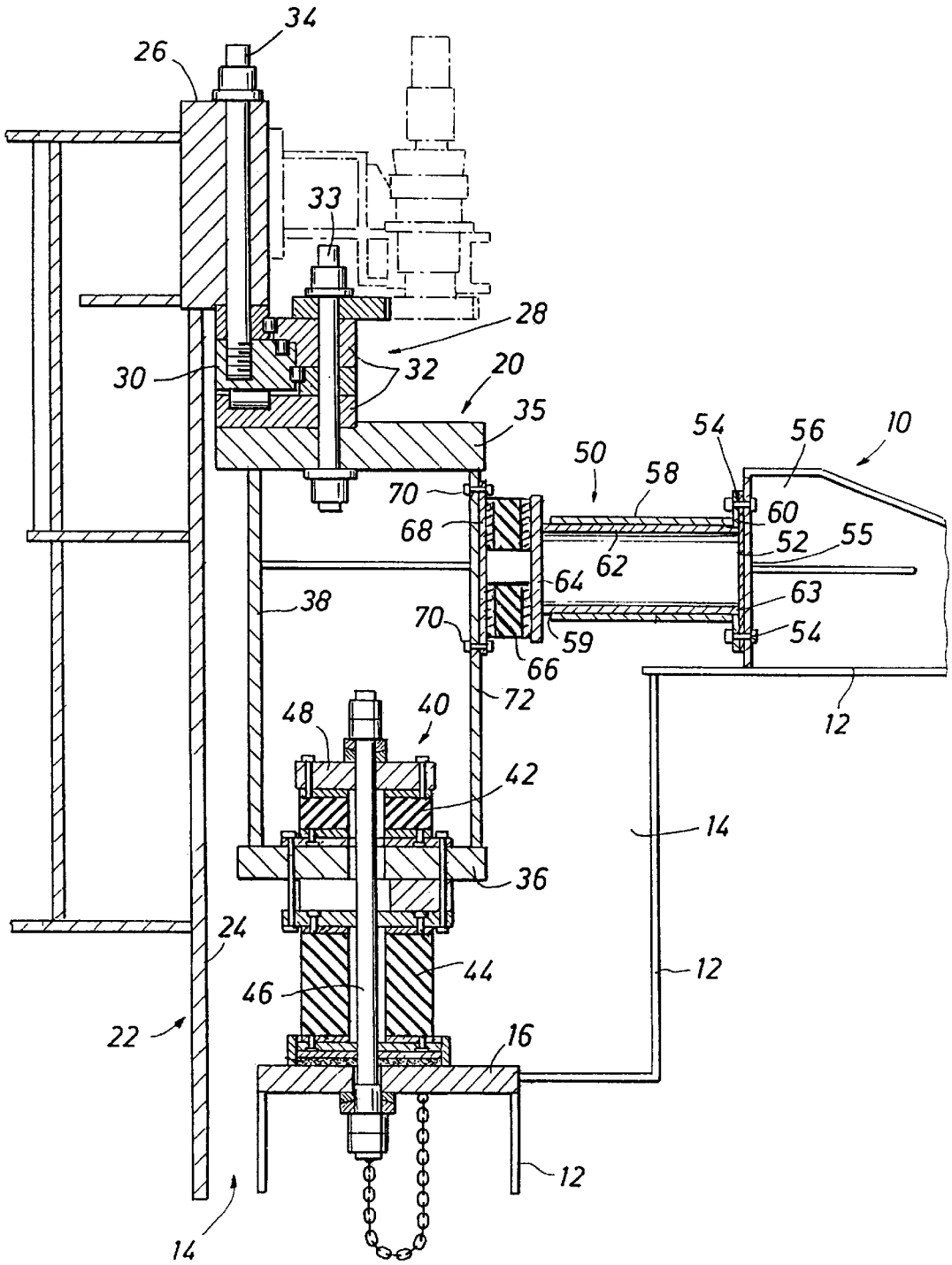
FIG. 1 is a partial cross section of a vessel having a mooring turret rotatably mounted in a moonpool with a radial spring assembly and a vertical or axial spring assembly positioned between the main bearing and the hull of the vessel.

Referring to FIG. 1, a vessel shown at 10 has a hull 12 with a moon pool generally indicated at 14 extending through the hull or body 12 of vessel 10. A horizontal case support ring 16 on hull 12 adjacent moon pool 14 supports a spring assembly generally indicated at 20 for turret 22 mounted within moon pool 14. Turret 22 is anchored to the sea floor by a plurality of mooring lines (not shown), and vessel 10 weathervanes about turret 22 as well known.

A plurality of spring assemblies 20, such as twenty, for example, are equally spaced about the outer periphery 24 of turret 22. FIG. 1 shows a single spring assembly for illustration. Turret 22 has an upper turret shear ring 26 extending outwardly from the outer periphery 24 of turret 22. Shear ring 26 supports turret 22 on a main upper bearing generally indicated at 28 including an inner ring or race 30 mounted on bearings within outer ring or race 32. Suitable studs 34 secure turret shear ring 26 to inner bearing ring or race 30 and outer bearing ring or race 32 are secured by studs 33 to an upper load applying support ring 35 of spring assembly 20. Spring assembly 20 includes a lower load applying support ring 36. An annular vertical ring 38 is secured between horizontal support rings 35 and 36.

An axial or vertical spring subassembly is shown generally at 40 including an upper elastomeric member 42 above load applying ring 36 and a lower elastomeric member 44 below load applying ring 36. A tie rod 46 extends between an upper retaining plate 48 and base support 16. Lower elastomeric pad 44 is effective for reacting downwardly applied vertical loads from load applying ring 36. Uplifting forces from turret 22 are reacted by upper elastomeric pad 42 which is placed in compression by tie rod 46 acting against retaining plate 48.

A radial spring subassembly of each spring assembly 20 is indicated generally at 50 and forms an important part of this invention. Radial spring subassembly 50 includes an outer end plate 52 secured by bolts 54 to a vertical surface 55 of abutment 56 on hull or deck 12 of vessel 10. An outer cylinder 58 includes an end flange 60 which is secured by bolts 54 to plate 52 and abutment 56. The outer cylinder 58 has an inner end 59 which faces but does not abut inner end plate 64 under normal centered conditions of turret 22 within moonpool 14 of hull 12. An inner telescoping cylinder 62 is received within outer cylinder 58 and is secured at its inner end to an inner end plate 64 which is secured to elastomeric member 66. The outer end 63 of inner cylinder 62 abuts against outer end plate 52, but outer cylinder 58 is free to move radially outwardly with respect to inner cylinder 62. An opposed inner end plate 68 which is also secured to elastomeric member 66 is secured by bolts 70 to a vertical mounting plate 72 which extends between and secured to upper and lower load applying rings 35, 36. Inner cylinder 62 and end plate 64 are arranged, dimensioned and designed for longitudinal, telescoping movement relative to outer cylinder 58 until end 63 of cylinder 62 abuts plate 52.

Operation

Outwardly directed radial movements of turret 22 toward subassembly 50 and inwardly directed radial movement of the vessel toward turret 22 due to ovaling of the vessel 10 are reacted by elastomeric member 66 in compression with the outer end 63 of inner cylinder 62 in abutting contact with outer end plate 52 and abutment 56 thereby to oppose or cushion such radial movement and resulting forces. Elastomeric member 66 is inoperable upon radial movement away from abutment 56 and outer end plate 52 because inner cylinder 62 telescopes away from outer end plate 52 within inner concentric cylinder 62. Thus, elastomeric member 66 is not placed in tension when there is relative outward radial movement of the turret and the vessel 12.

End plate 64 of elastomeric member 66 is maintained in a generally parallel relation to end plate 52 secured to hull 12 by inner sliding cylinder 62 even though cylinder 62 and plate 64 may rotate slightly relative to outer cylinder 58 which may result from torsional loads. Thus, vertical movement of turret 22 from the position of FIG. 1 is reacted in shear by elastomeric member 66 without any substantial torsional or locking loads being applied against elastomeric member 66.

From the above, it is apparent that elastomeric member or spring 66 is effective in reacting radial and torsional loads exerted by turret 22. Elastomeric member 66 is also partially effective in assisting vertical sing subassembly 40 in reacting vertical loads even though elastomeric members 66 do not have enough lateral stiffness to react against the entire vertical load.

While a preferred embodiment of the present invention has been illustrated in detail, it is apparent that modifications and adaptations of the preferred embodiment win occur to those skilled in the art. However, it is to be expressly understood that such modifications and adaptations are within the spirit and scope of the present invention.

What is claimed is:

1. A radial support arrangement (50) for a turret (22) which is rotatably supported within a moonpool (14) of a vessel (12) comprising, a mounting plate (72) positioned substantially vertically and radially outwardly of said turret (22) and rotatably coupled to said turret (22);

a surface (55) of said vessel (12) which is positioned substantially vertically and is spaced a radial distance from said mounting plate (72);

a radial elastomeric spring assembly (50) including an elastomeric pad (66) sandwiched between inner (68) and outer (64) plates, with said inner plate (68) fixed to said mounting plate (72), an inner telescoping cylinder (62) having an inner end secured to said outer plate (64), and having an outer end (63), an outer telescoping cylinder (58) disposed in telescoping sliding relation about the outside of said inner telescoping cylinder (62), said outer telescoping cylinder (58) having an end plate (52) secured at its outer end, with said end plate (52) being secured to said surface (55) of said vessel (12), said inner (62) and outer (58) telescoping cylinders being arranged, dimensioned and designed such that when said outer end (63) of said inner cylinder (62) abuts said end plate (52) of said outer cylinder (58) said elastomeric pad (66) reacts in compression to relative radial movements of said turret and said hull toward each other, but no tension is placed on said elastomeric pad (66) with relative radial movements of said turret and said hull away from each other.

2. The arrangement of claim 1 wherein, said surface (55) is positioned on an abutment (56) of said vessel (12) adjacent to said moonpool (14).

3. The arrangement of claim 1 wherein, said radial elastomeric spring assembly partially reacts against vertical movements of said turret (22) relative to said vessel (12).

4. A radial support arrangement (50) for a turret (22) which is rotatably supported on a vessel (12) comprising, a mounting plate (72) positioned substantially vertically and radially outwardly of said turret (22) and rotatably coupled to said turret (22), a mounting surface (55) of said vessel which is positioned substantially vertically and is spaced a radial distance from said mounting plate (72), a radial elastomeric spring assembly (50) including an elastomeric pad (66) coupled between said mounting plate and said mounting surface by two telescoping cylinders, where one telescoping cylinder is coupled to said elastomeric pad (66) and the other telescoping cylinder is coupled to said mounting surface (55), said telescoping cylinder being arranged, dimensioned and designed such that said elastomeric pad (66) reacts in compression to relative radial movements of said turret and said hull toward each other, but no tension is placed on said elastomeric pad (66) in response to relative radial movements of said turret and said hull away from each other.

* * * * *

UNITED STATES PATENT AND TRADEMARK OFFICE

CERTIFICATE OF CORRECTION

PATENT NO. : 6,263,822 B1
DATED : July 24, 2001
INVENTOR(S) : William L. Fontenot; Miles A. Hobdy; L. Terry Boatman It is certified that error appears in the above-identified patent and that said Letters Patent is hereby corrected as shown below:

Column 1,
Line 30, after the word "post", insert -- . --.
Line 57, delete "moimted", insert -- mounted --

Column 2,
Line 18, delete "case", insert -- base --
Line 28, after the word "assembly", insert -- 20 --

Column 3,
Line 36, delete "win", insert -- will --

Signed and Sealed this

First Day of January, 2002

*Attest:*

*Attesting Officer*

JAMES E. ROGAN
*Director of the United States Patent and Trademark Office*